US006425756B2

(12) United States Patent
Ebner et al.

(10) Patent No.: US 6,425,756 B2
(45) Date of Patent: Jul. 30, 2002

(54) TOWER FURNACE FOR HEAT TREATMENT OF METAL STRIPS

(76) Inventors: Peter Ebner, Bergham 168; Heribert Lochner, Burgwallstrasse 19, both of A 4060 Leonding (AT)

( * ) Notice: Subject to any disclaimer, the term of this patent is extended or adjusted under 35 U.S.C. 154(b) by 0 days.

(21) Appl. No.: 09/886,719

(22) Filed: Jun. 21, 2001

(30) Foreign Application Priority Data

Jun. 29, 2000 (AT) ..... 1113/00

(51) Int. Cl.[7] ..... F23M 5/00; F27B 9/00; F27B 5/14; C21D 9/54; C21D 9/56

(52) U.S. Cl. ..... 432/128; 266/108; 432/143; 219/390; 110/336

(58) Field of Search ..... 219/390, 388; 266/103, 108; 432/8, 120, 128, 143, 148; 181/282; 110/184, 119, 120, 121, 124, 308, 336

(56) References Cited

U.S. PATENT DOCUMENTS 1,485,118 A * 2/1924 Larsson
2,218,354 A * 10/1940 Keller
2,823,292 A * 2/1958 Kunzle
3,721,520 A * 3/1973 Bloom
4,295,033 A * 10/1981 Lindgren et al.
4,398,474 A * 8/1983 Berg
4,820,905 A * 4/1989 Iwata et al.
6,031,206 A * 2/2000 Ebner et al.

FOREIGN PATENT DOCUMENTS

EP 0 675 208 8/1994

* cited by examiner

*Primary Examiner*—Ira S. Lazarus
*Assistant Examiner*—K. B. Rinehart
(74) *Attorney, Agent, or Firm*—Collard & Roe, P.C.

(57) ABSTRACT

A tower furnace for heat treatment of metal strips having a pre-heating section (3) and a high-temperature section (5) connected thereto at the top forming a housing (4) separate from the pre-heating section (3) is described, whereby the pre-heating section (3) equipped with a preferably gas-heated muffle (7) exhibits a connecting stopper (6) made of heat-insulating material for the high-temperature section (5) inserted into the muffle (7). To create advantageous structural conditions it is proposed that the high-temperature section (5) is also fitted with a preferably gas-heated muffle (12) which encloses the connecting stopper (6) externally and connects to this in a gas-tight manner preferably by way of a fluid seal (14).

2 Claims, 2 Drawing Sheets

TOWER FURNACE FOR HEAT TREATMENT OF METAL STRIPS

FIELD OF THE INVENTION

The present invention relates to a tower furnace for heat treatment of metal strips having a pre-heating section and a high-temperature section connected thereto at the top forming a housing separate from the pre-heating section, whereby the pre-heating section equipped with a preferably gas-heated muffle exhibits a connecting stopper made of heat-insulating material for the high-temperature section inserted into the muffle.

DESCRIPTION OF THE PRIOR ART

Metal strips, in particular those made of chrome steel or chrome-nickel steel, are continuously bright-cooled in an inert gas atmosphere of hydrogen or a hydrogen-nitrogen mixture in so-called tower furnaces which can be designed with or without a muffle. The advantage of the heat treatment of metal strips over an externally heated muffle is that gas burners can be used without exhaust gases impairing the inert gas atmosphere in the muffle interior. The furnace temperature is, however, limited by the heat tolerance of the muffle. In addition, on account of the quantity of heat to be transferred from the muffle to the metal strip the length of the muffle determines the attainable throughput rate of the metal strip to be treated, such that the muffle clamped in the vicinity of its upper end is also subjected to load by the dead weight, apart from the heat load, which results in limiting of the length of the muffle as a result of the dead weight despite a wall thickness which increases from bottom to top in the longitudinal direction of the muffle. In this respect the stability of the special steel used for the muffle reduced at high temperature loads is to be considered.

Tower furnaces without muffles have a fireproof lining and are heated electrically so that higher furnace temperatures can be achieved. Since the fireproof furnace lining is somewhat porous when the tower furnace is opened it absorbs ambient air which has to be rinsed out by use of nitrogen gas, for example, before trouble-free heat treatment of the metal strips under inert gas atmosphere can be ensured. After they are opened tower furnaces without muffles are not ready for service again for several days on account of the required rinsing periods. There is also considerable hydrogen consumption, as the residue of atmospheric oxygen remaining after rinsing binds together with the hydrogen of the inert gas to form water.

In order to achieve high throughput of the metal strips to be treated, in spite of the restrictions associated with a muffle insert, it is known (EP 0 675 208 A1) to connect a high-temperature section without a muffle to the pre-heating section of a tower furnace, fitted with a muffle, which forms a housing separate from the pre-heating section, which is in turn set on the housing of the pre-heating section. The metal strip to be treated exits from the muffle of the pre-heating section through a connecting stopper made of heat-insulating material inserted into the top of the muffle into high-temperature section, where it is heated by means of the electrical heating to the required final temperature before it reaches a cooler set on the top of the tower furnace. Because of the high-temperature section without a muffle an advantageously lower outlet temperature for the muffle insert of the strip to be treated from the muffle can be taken into consideration so that the restrictions imposed by the heat and weight loads of the muffle cannot have an effect on the outcome of the heat treatment or the throughput rate.

However, it is a disadvantage that the high-temperature section with its fireproof lining stipulates a rinse period which is considerably longer compared to muffle furnaces after the furnace is opened, with a corresponding increase in hydrogen consumption. Additionally, in the vicinity of the high-temperature section the economically more beneficial gas heating must be dispensed with in flavor of more expensive electrical heating.

SUMMARY OF THE INVENTION

The object of the present invention therefore is to create a tower furnace of the type outlined initially for heat treatment of metal strips, such that despite the restrictions imposed by the heat and weight loads of the muffle the required final strip temperature can be achieved without the disadvantages associated with the use of a high-temperature section without a muffle having to be considered.

The invention solves the task by the high-temperature section also being provided with a preferably gas-heated muffle which encloses the connecting stopper externally and connects to this preferably by way of a fluid seal in a gas-tight manner.

Since as a result of these measures the high-temperature section also has a muffle the advantages of a muffle can be exploited beneficially in the high-temperature section, particularly with respect to rinsing and possible gas heating. Due to restriction of the length of the muffle in the high-temperature section the muffle load can be limited by the dead weight, leading to a higher temperature capacity on account of the associated lesser stability requirements, which ensures the required end temperature of the metal strips to be treated. Only a transfer as heat loss-free as possible between the pre-heating section and the high-temperature section by way of the connecting stopper is to be provided. For this purpose the connecting stopper is enclosed externally by the lower end of the muffle of the high-temperature section, whereby a gas-tight connection must be attained between connecting stopper and muffle of the high-temperature section, and this with the possibility of axial displacement of the muffle compared to the connecting stopper for equalising heat expansion of the muffle. A fluid seal known per se can be used for this purpose to advantage. But it is also possible to produce the gas-tight connection by using a bellows-like sleeve positioned between muffle and connecting stopper. The heat-insulating fireproof material of the connecting stopper has a relatively small volume, such that the rinsing procedure is barely influenced by the connecting stopper. Since the connecting stopper is located in the vicinity of the thermal radiation and the muffle of the pre-heating section as well as the muffle of the high-temperature section, strip heating substantially covering the length of the furnace can be assumed having an advantageous effect on the required overall length of the furnace.

For ensuring strip heating by the connecting stopper which is as unhindered as possible the connecting stopper should be provided with a sufficiently large through cross-section for the metal strips so that the heat radiation of both muffles can extend into the region of the connecting stopper also. For this very purpose the connecting stopper can have a through cross-section for the metal strip to be treated with a minimum width measured vertically to the metal strip and corresponding to half the external radius of the connecting stopper.

BRIEF DESCRIPTION OF THE DRAWING

The object of the invention is illustrated in the diagram, in which.

DESCRIPTION OF THE PREFERRED EMBODIMENTS

Figure 1:
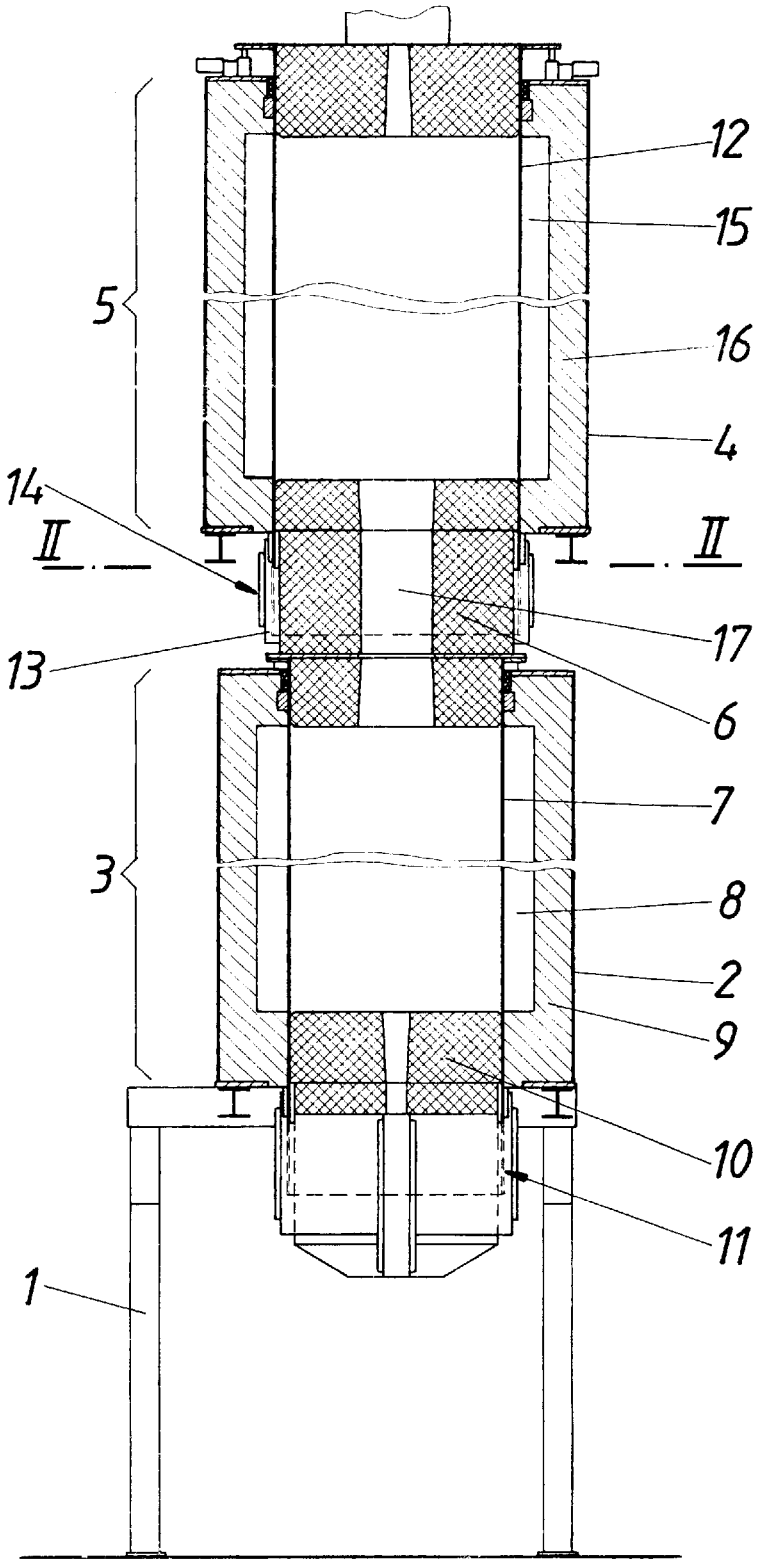
FIG. 1 shows a tower furnace according to the present invention for heat treatment of metal strips in an exposed view in a diagrammatic longitudinal section.

The tower furnace as illustrated for heat treatment of metal strips exhibits a stand 1 bearing a housing 2 for a pre-heating section 3 and a housing 4 for a high-temperature section 5 above pre-heating section 3. Both these furnace sections 3 and 5 are connected to one another by way of a connecting stopper 6 made of a heat-insulating fireproof material. Lower pre-heating section 3 is fitted with a muffle 7 which is inserted into housing 2 from above and which can also disassembled upwards if housing 4 of the high-temperature section is specifically moved sideways in furnace stand 1. Standard gas burners, not illustrated here for the sake of clarity, are employed for heating muffle 7, by means of which annular space 8 between muffle 7 and fireproof lining 9 of housing 2 is heated. The lower end of muffle 7 is formed by a stopper 10 in conventional manner, whereby a fluid seal 11 is provided in the form of an annular space enclosing the stopper for gas-tight connection between muffle 7 and stopper 10, which is filled with a sealing fluid such as oil and projects into the lower end of muffle 7.

High-temperature section 5 of the tower furnace is designed in like fashion. With its lower end muffle 12 of high-temperature section 5 inserted into housing 4 from above encloses connecting stopper 6 which bears on its outside an annular space 13 for a fluid seal 14, such that the lower end of muffle 12 dips into the bath of fluid seal 14. This effectively ensures gas-tight connection of muffle 12 on connecting stopper 6, without obstructing equalising of thermal expansion of muffle 12. Muffle 12 is heated advantageously by means of gas burners whose waste gases flowing into annular space 15 between muffle 12 and housing lining 16 heat muffle 12.

Due to the tower furnace being divided into a pre-heating section 3 and a high-temperature section 5 the required final temperature for the metal band to be treated can be reached, despite the respective use of a muffle 7 or 12 and without any fear of overloading muffles 7 and 12. The result of the lower temperature in pre-heating section 3 and the restricted length of muffle 7 is the advantageous exploitation of the material properties of muffle 7 which may have an exemplary length of 26 m. In the case of the present embodiment muffle 12 for high-temperature section 5 requires a length of 10 m only for the desired final strip temperature of 1100° C. for example to be reached. Owing to the lesser length of muffle 12 the load from the dead weight remains low, so that the temperature load can be increased because of the associated lower stability requirements on the material. By way of comparison the temperature load of muffle 7 can be kept lower, thus allowing higher stability values to be utilised. This means that at a length of 26 m and made of special alloy steel, muffle 7 has a weight of ca. 17 t, whereas the weight of muffle 12 at a length of 10 m is ca. 7 t. A comparable muffle having a total length of 36 m would have a weight of ca. 33 t. It is evident that a saving of almost 30% in weight is possible by the design according to the present invention. In addition, due to the possibility of installing muffles 7 and 12 separately after one another the required installation height can be reduced considerably. While an installation height of ca. 80 m is required in the case of a continuous muffle with a length of 36 m, the installation height according to the invention is 60 m only, if a length of ca. 26 m is estimated for muffle 7 and a length of 10 m is estimated for muffle 12.

Figure 2:
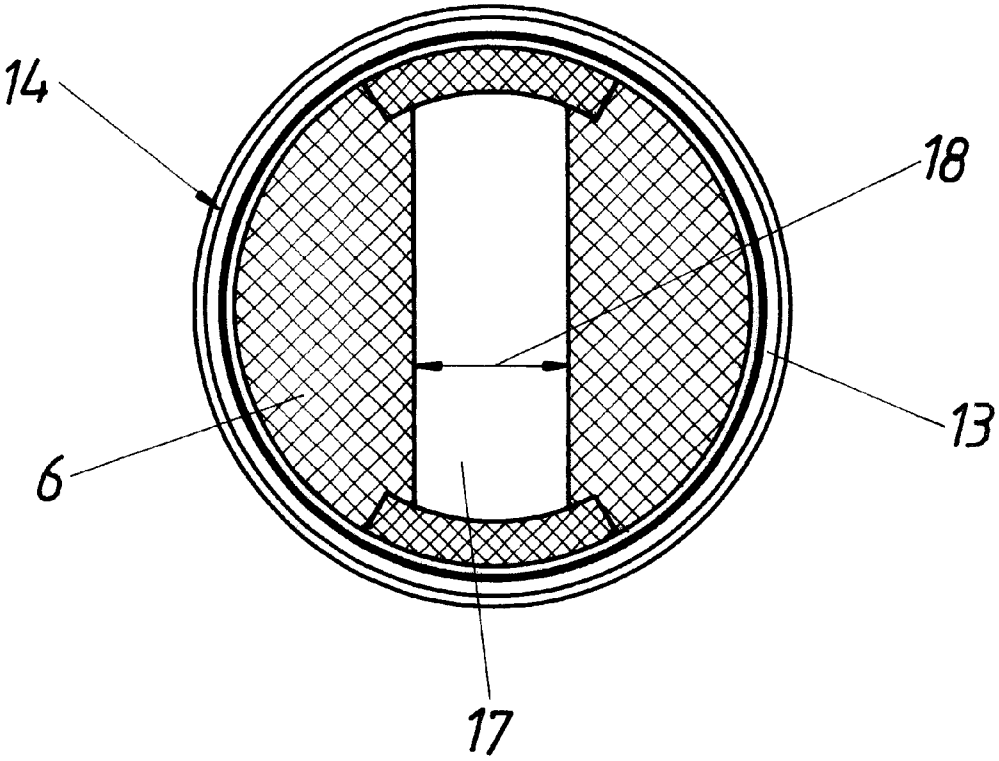
FIG. 2 shows a section through the connecting stopper along line II—II of FIG. 1 on an enlarged scale.

In order to ensure the most continuous strip heating in the transition region between preheating section 3 and high-temperature section 5 the cross-section of passage 17 of connecting stopper 6 is to be selected sufficiently large for the metal strip to be treated. If the through cross-section exhibits a minimum width 18, corresponding to half the external radius or a quarter of the outer diameter of connecting stopper 6 and measured vertically to the metal strip, as is evident from FIG. 2, advantageous ratios which have a beneficial effect on the overall length of the tower furnace result with respect to the penetration coefficient of the thermal radiation of muffles 7 and 12.

What is claimed is:

1. A tower furnace for heat treatment of metal strips comprising a pre-heating section and a high-temperature section connected thereto at the top forming a housing separate from the pre-heating section, the pre-heating section equipped with a heated muffle including a connecting stopper made of heat-insulating material for the high-temperature section inserted into the muffle, the high-temperature section being also fitted with a heated muffle which encloses the connecting stopper externally and connects to the muffle of the high temperature section in a gas tight manner by way of a fluid seal.

2. Tower furnace as claimed in claim 1, wherein the connecting stopper has a through cross-section for the metal strip to be treated with a minimum width measured vertically to the metal strip and corresponding to half the external radius of the connecting stopper.

* * * * *